US007246989B2

(12) United States Patent
Glasspoole et al.

(10) Patent No.: US 7,246,989 B2
(45) Date of Patent: Jul. 24, 2007

(54) SHROUD LEADING EDGE COOLING

(75) Inventors: David Glasspoole, St. Lambert (CA); Ricardo Trindade, Coventry, CT (US)

(73) Assignee: Pratt & Whitney Canada Corp., Longueuil, Quebec (CA)

( * ) Notice: Subject to any disclaimer, the term of this patent is extended or adjusted under 35 U.S.C. 154(b) by 179 days.

(21) Appl. No.: 11/008,256

(22) Filed: Dec. 10, 2004

(65) Prior Publication Data

US 2006/0123794 A1 Jun. 15, 2006

(51) Int. Cl.
*F01D 25/12* (2006.01)

(52) U.S. Cl. ..... 415/1; 415/191; 415/173.1; 415/115

(58) Field of Classification Search ..... 415/1, 415/191, 173.1, 228, 115
See application file for complete search history.

(56) References Cited

U.S. PATENT DOCUMENTS 4,157,232 A 6/1979 Bobo et al.
4,311,431 A * 1/1982 Barbeau ..... 415/173.6
4,522,557 A * 6/1985 Bouiller et al. ..... 415/115
4,551,064 A 11/1985 Pask
4,752,185 A * 6/1988 Butler et al. ..... 415/175
5,127,793 A 7/1992 Walker et al.
5,155,993 A * 10/1992 Baughman et al. ..... 60/226.1
5,169,287 A 12/1992 Proctor et al.
5,584,651 A 12/1996 Pietraszkiewicz et al.
5,593,277 A 1/1997 Proctor et al.
5,871,333 A * 2/1999 Halsey ..... 415/173.1
5,993,150 A 11/1999 Liotta et al.
6,139,257 A 10/2000 Proctor et al.
6,196,792 B1 3/2001 Lee et al.
6,231,303 B1 5/2001 Tiemann et al.
6,685,425 B2 2/2004 Poccia et al.

* cited by examiner

*Primary Examiner*—Ninh H. Nguyen
(74) *Attorney, Agent, or Firm*—Ogilvy Renault LLP

(57) ABSTRACT

A cooling device includes a plurality of passages extending through outer platforms of turbine vane segments for directing cooling air in a choked flow condition towards a downstream turbine shroud.

8 Claims, 2 Drawing Sheets

SHROUD LEADING EDGE COOLING

TECHNICAL FIELD

The invention relates generally to turbine engine constructions and, more particularly, to cooling the turbine shrouds thereof.

BACKGROUND OF THE ART

It is well known that increasingly high turbine operative temperatures have made it necessary to cool hot turbine parts. A number of conventional turbine engine constructions employ impingement cooling schemes for cooling the outer portion of stationary turbine shrouds. While cooling improves the overall efficiency of the turbine engine, some leakage occurs which reduces efficiency, as unnecessary overflow of cooling air is wasted and reduces overall turbine engine efficiency.

Accordingly, there is a need to provide an improved cooling for gas turbine engines, particularly for cooling a stationary turbine shroud.

SUMMARY OF THE INVENTION

It is therefore an object of this invention to provide a cooling device for a gas turbine engine having a turbine rotor stage positioned immediately downstream of a turbine vane ring assembly. The turbine rotor stage includes a plurality of turbine blades rotatably mounted within a stationary turbine shroud. The cooling device comprises a cavity defined in a vane segment of the turbine vane ring assembly in fluid communication with a cooling air source for cooling an outer platform of the vane segment, and a plurality of passages in fluid communication with the cavity and defining openings thereof on a trailing edge of the outer platform. The passages are directed towards a leading edge of a section of the turbine shroud, and are sized to in use maintain a choked flow condition relative to flow passing therethrough to the shroud leading edge.

In another aspect, the present invention provides a gas turbine engine which comprises a casing defining a main fluid path therethrough including a gas generator section therein, a compressor assembly for driving a main air flow along the main fluid path and for providing a cooling air source, and a turbine assembly including a stationary shroud supported within the casing and surrounding a plurality of rotatable turbine blades. A plurality of vanes with outer platforms are positioned immediately upstream of the turbine shroud for directing hot gas from the gas generator section in a swirl direction into the turbine shroud. A plurality of cooling passages are in fluid communication with the cooling air source and extend through the outer platform for directing a cooling air flow towards a leading edge of the shroud to create impingement cooling thereon. The passages are sized to maintain said cooling air flow therethrough in a choked flow condition.

In another aspect, the present invention provides a method for cooling a leading edge of a stationary turbine shroud of a gas turbine engine. The method comprises the steps of directing a cooling air flow through a vane platform to impinge a gas path exposed portion of the turbine shroud, and choking the flow provided to the turbine shroud to thereby meter the amount of cooling air provided to the turbine shroud.

Further details of these and other aspects of the present invention will be apparent from the detailed description and figures included below.

DESCRIPTION OF THE DRAWINGS

Reference is now made to the accompanying figures depicting aspects of the present invention, in which.

DETAILED DESCRIPTION OF THE PREFERRED EMBODIMENTS

Figure 1:
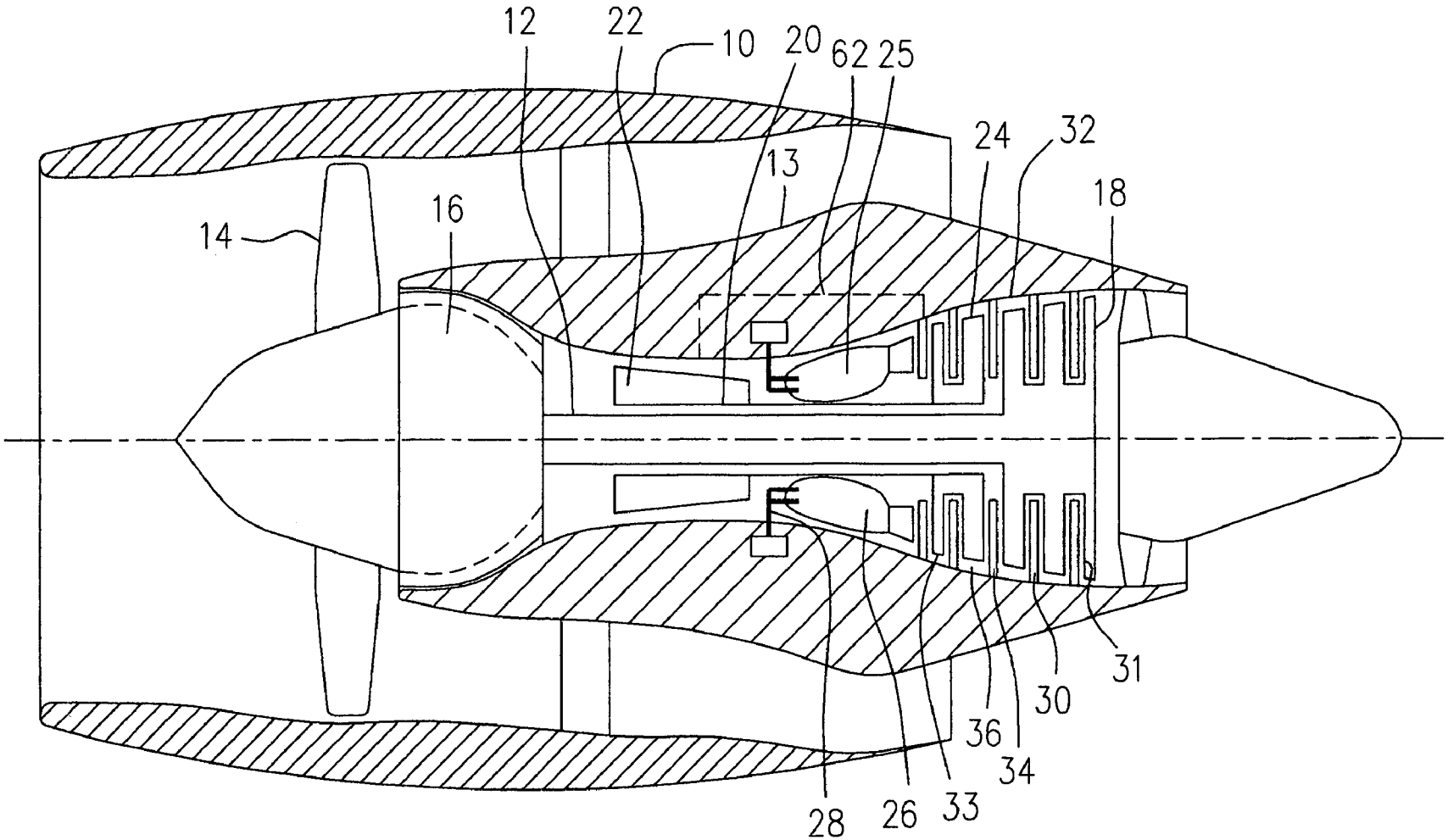
FIG. 1 is a schematic cross-sectional view of a turbofan gas turbine engine, as an example illustrating an application of the present invention.
Figure 2:
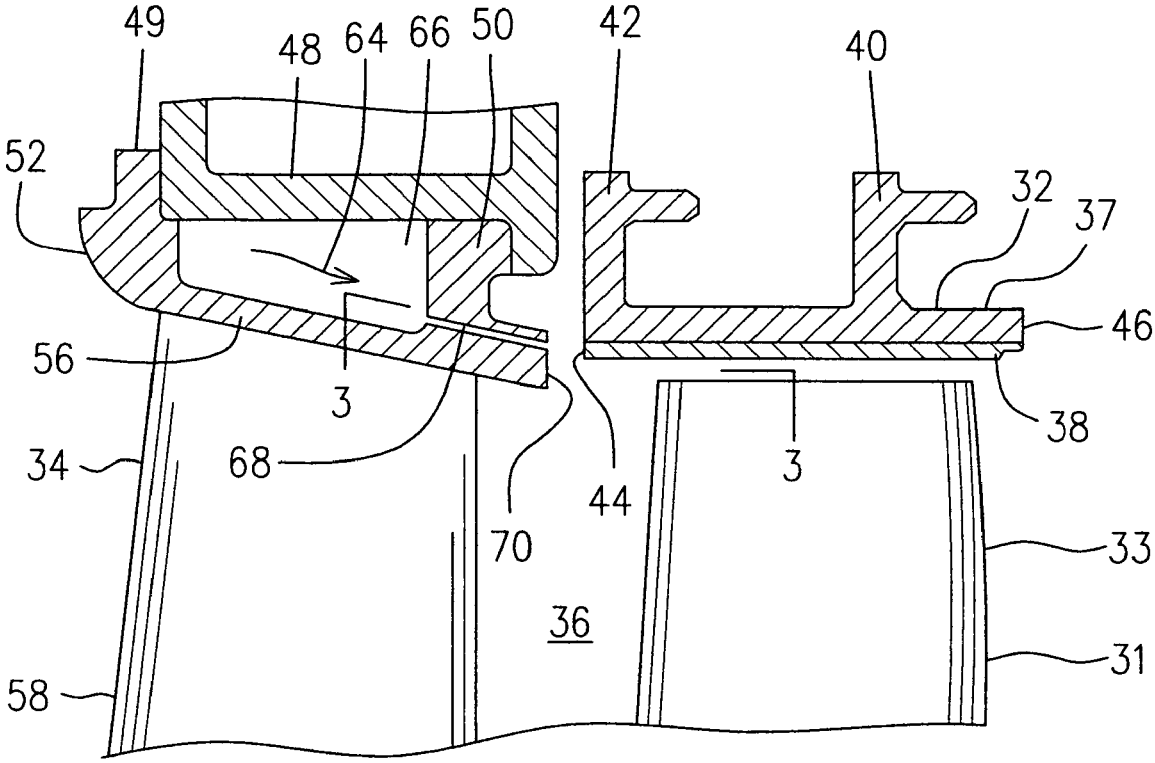
FIG. 2 is a partial cross-sectional view of a turbine section of the engine of FIG. 1, showing one embodiment of the present invention.

Referring to FIGS. 1 and 2, a turbofan gas turbine engine incorporating an embodiment of the present invention is presented as an example of the application of the present invention and includes a housing or a nacelle 10, a core casing 13, a low pressure spool assembly seen generally at 12 which includes a fan assembly 14, a low pressure compressor assembly 16 and a low pressure turbine assembly 18, and a high pressure spool assembly seen generally at 20 which includes a high pressure compressor assembly 22 and a high pressure turbine assembly 24. The core casing 13 surrounds the low and high pressure spool assemblies 12 and 20 to define a main fluid path (not indicated) therethrough. In the main fluid path there is provided a combustor seen generally at 25 with fuel injecting means 28, to constitute a gas generator section 26. The compressor assemblies 16 and 22 drive a main air flow (not indicated) along the main fluid path and provide a cooling air source. The low and high pressure turbine assemblies 18, 24 include a plurality of stator vane stages 30 and rotor stages 31. Each of the rotor stages 31 has a plurality of rotor blades 33 rotatably mounted within a turbine shroud assembly 32 and each of the stator vane stages 30 includes a turbine vane ring assembly 34 which is positioned immediately upstream and/or downstream of a rotor stage 31, for directing hot combustion gases into or out of a section of an annular gas path 36 which is in turn a section of the main fluid path downstream of the gas generator section 26, and through the stator vane stages 30 and rotor stages 31.

Figure 3:
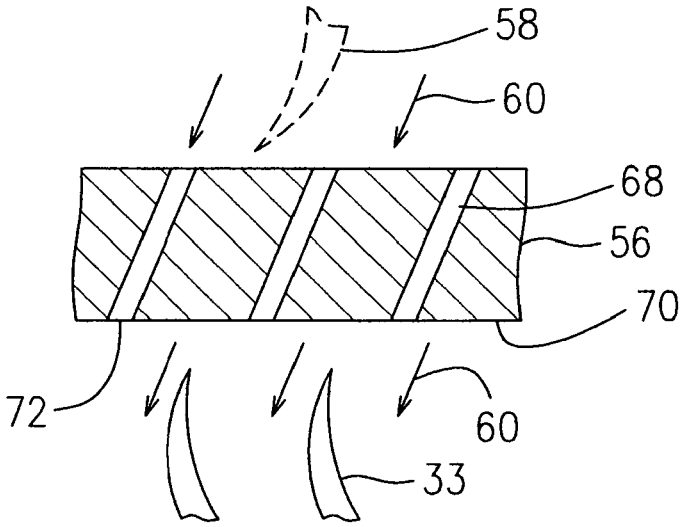
FIG. 3 is a cross-sectional view of the embodiment of FIG. 2 taken along line 3—3 in FIG. 2, showing a gas path swirl direction.

Referring to FIGS. 2 and 3, the combination of the turbine shroud assembly 32 and the turbine vane ring assembly 34 is described. The turbine shroud assembly 32 includes a plurality of shroud segments 37 (only one shown), each of which includes a shroud ring section 38 having two radial legs 40, 42 with respective hooks (not indicate) conventionally supported within an annular shroud structure (not shown) formed with a plurality of shroud support segments. The annular shroud support structure is in turn supported within the core casing 13 (see FIG. 1). The shroud segments 37 are joined one to another in a circumferentially direction and thereby form the shroud assembly 32 which encircles the rotor blades 33, and in combination with the rotor stage 31 defines a section of the annular gas path 36. The shroud ring section 38 includes a leading edge 44 and a trailing edge 46 thereof.

The turbine vane ring assembly 34 is disposed immediately upstream of the turbine rotor stage 31 and the shroud assembly 32, and includes a plurality of vane segments 52 (only one shown) joined one to another in a circumferential direction. The vane segments 52 each include an inner platform (not shown) conventionally supported on a stationary support structure (not shown) and an outer platform 56. The turbine vane ring assembly 34 is conventionally supported within an annular stationary support structure 48 by means of a plurality of front and rear legs 49 and 50, each incorporated with the outer platform 56 of the vane segments 52. The annular stationary support 48 is in turn supported within the core casing 13 of FIG. 1. One or more (only one shown) airfoils 58 radially extending between the inner platform and the outer platform 56, divide an upstream section of the annular gas path 36 relative to the rotor stage 31, into sectorial gas passages for directing hot gas flow into the rotor stage 31 in a swirl direction, as indicated by arrows 60 illustrated in FIG. 3.

The turbine vane assembly 34 and the turbine rotor stage 31 are subjected to high temperatures caused by the hot gas during operation. Therefore, appropriate cooling thereof is required. This is achieved through fluid communication thereof with the cooling air source provided by either one of, or both the compressor assemblies 16, 22, as illustrated by broken line 62 in FIG. 1. In this particular embodiment, the compressed cooling air as indicated by arrow 64 in FIG. 2, is introduced in a cavity 66 defined in the vane segment 52 of the turbine vane ring assembly 34, through the fluid communication 62 of FIG. 1 for cooling the outer platform 56 of the vane segment 52. A plurality of passages 68 in fluid communication with the cavity 66 extend axially through a portion of the outer platform 56 which is integrated with the rear leg 50. The passages 68 define openings 72 thereof on a trailing edge 70 of the outer platform 56. The openings 72 of the passages 68 are radially positioned to substantially align with the leading edge 44 of the turbine shroud section 38 of the downstream shroud assembly 32, for directing a cooling air flow from the cavity 66 therethrough in order to cause impingement cooling on the leading edge 44 of the turbine shroud section 38. Once this cooling air flow has impinged on the leading edge 44 of the shroud ring section 38, it then enters the gas path 36.

The passages 68 are preferably sized for a choked flow condition to prevent overflow of the cooling air flow and achieve adequate cooling. This is beneficial for reducing cooling air consumption while providing adequate cooling, thereby improving overall engine efficiency. The cooling hole(s) are therefore sized to provide adequate cooling in a choked flow condition, and the choked flow condition ensures that additional cooling is not supplied and thus wasted. In this manner, cooling flow is effectively metered and cooling efficiency control achieved at the design stage.

The passages 68 are preferably appropriately distributed, for example, in a substantially equal distance one to another, in a circumferential direction with respect to the shroud assembly 32 such that the cooling air flow directed by the passages 68 creates a cooling air barrier for reducing hot gas ingestion into a cavity (not indicated) between the trailing edge 70 of the outer platform 56 of the vane segment 52 and the leading edge 44 of the shroud section 38 of the shroud segment 37. It should be noted that the number and size of the passages 68 of the entire turbine vane ring assembly 34 are preferably in coordination with the circumferentially distribution thereof, not only to ensure a choked flow condition in order to permit a predetermined maximum flow amount of cooling air for adequate cooling on the leading edge 44 of the entire turbine shroud assembly 32, but also ensure an adequate cooling air barrier to minimize the hot gas ingestion between the turbine vane ring assembly 34 and the turbine shroud assembly 38.

The passages 68 further preferably extend axially and circumferentially in the gas path swirl direction as indicated by arrows 60 in FIG. 3, which reduces interaction turbulence between the adjacent layers of hot gas flow in the gas path 36 and the cooling air flow discharged from the passages 68 towards the leading edge 44 of the turbine shroud sections 38.

The above description is meant to be exemplary only, and one skilled in the art will recognize that changes may be made to the embodiments described without departing from the scope of the invention disclosed. For example, the turbofan illustrated in FIG. 1 is an example used to illustrate the application of the present invention, however, the present invention is applicable to other types of gas turbine engines for the implementation of other embodiments of this invention. Broken line 62 in FIG. 1 as a symbolic mark indicating a fluid communication between the cavity 66 of vane segments 52 and a compressed cooling air source, and does not indicate any particular configurations or locations of such a compressed air source. Various compressed cooling air sources are possible in various different embodiments of this invention, and are particularly designed to correspond with various types of gas turbine engines. Still other modifications which fall within the scope of the present invention will be apparent to those skilled in the art, in light of a review of this disclosure, and such modifications are intended to fall within scope of the appended claims.

The invention claimed is:

1. A cooling device for a gas turbine engine having a turbine rotor stage positioned immediately downstream of a turbine vane ring assembly, the turbine rotor stage including a plurality of turbine blades rotatably mounted within a stationary turbine shroud, the cooling device comprising:

a cavity defined in a vane segment of the turbine vane ring assembly, in fluid communication with a cooling air source for cooling an outer platform of the vane segment; and a plurality of passages in fluid communication with the cavity and defining openings thereof on a trailing edge of the outer platform, the passages being directed towards a leading edge of a section of the turbine shroud, the passages being sized to in use maintain a choked flow condition relative to flow passing therethrough to the shroud leading edge.

2. The cooling device as claimed in claim 1 wherein the passages are angled in a gas path swirl direction.

3. The cooling device as claimed in claim 1 wherein the passages extend axially through a portion of the platform which is integrated with a rear support leg of the vane segment.

4. A gas turbine engine comprising:

a casing defining a main fluid path therethrough including a gas generator section therein;

a compressor assembly for driving a main air flow along the main fluid path and for providing a cooling air source;

a turbine assembly including a stationary shroud supported within the casing and surrounding a plurality of rotatable turbine blades, a plurality of vanes with outer platforms positioned immediately upstream of the turbine shroud for directing hot gas from the gas generator section in a swirl direction into the turbine shroud, a plurality of cooling passages in fluid communication with the cooling air source and extending through the outer platform for directing a cooling air flow towards a leading edge of the shroud to create impingement cooling thereon, the passages being sized to maintain said cooling air flow therethrough in a choked flow condition.

5. The gas turbine engine as claimed in claim 4 wherein the passages extend axially and circumferentially in a swirl direction of the hot gas.

6. A method for cooling a leading edge of a stationary turbine shroud of a gas turbine engine, the method comprising the steps of directing a cooling air flow through a vane platform to impinge a gas path exposed portion of the turbine shroud, and choking the flow provided to the turbine shroud to thereby meter the amount of cooling air provided to the turbine shroud.

7. The method as claimed in claim 6 further comprising a step of swirling the flow in a gas path direction prior to impinging the shroud.

8. The method as claimed in claim 7 wherein the flow impinges the leading edge of the section of the turbine shroud.

* * * * *